US011348504B2

(12) United States Patent
Kim et al.

(10) Patent No.: US 11,348,504 B2
(45) Date of Patent: May 31, 2022

(54) DISPLAY DRIVER INTEGRATED CIRCUIT (DDI) CHIP AND DISPLAY APPARATUS

(71) Applicant: SAMSUNG ELECTRONICS CO., LTD., Suwon-si (KR)

(72) Inventors: Youngmok Kim, Yongin-si (KR); Kyunglyong Kang, Hwaseong-si (KR); Jungu Kang, Hwaseong-si (KR); Boyoung Seo, Suwon-si (KR); Yongsang Jeong, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/139,449

(22) Filed: Dec. 31, 2020

(65) Prior Publication Data

US 2021/0383735 A1 Dec. 9, 2021

(30) Foreign Application Priority Data

Jun. 5, 2020 (KR) ..... 10-2020-0068605

(51) Int. Cl.
*G09G 3/20* (2006.01)

(52) U.S. Cl.
CPC ..... *G09G 3/20* (2013.01); *G09G 2300/0842* (2013.01); *G09G 2310/0275* (2013.01); *G09G 2310/08* (2013.01)

(58) Field of Classification Search
CPC .. G09G 2330/028; G09G 5/003; G09G 5/006; G09G 2300/0426; G09G 3/2092; G09G 3/3275
See application file for complete search history.

(56) References Cited

U.S. PATENT DOCUMENTS

| | | | | |
|---|---|---|---|---|
| 9,514,712 | B2 | 12/2016 | Park et al. | |
| 9,734,775 | B2 | 8/2017 | Davis et al. | |
| 2005/0230723 | A1 | 10/2005 | Van Der Zaag et al. | |
| 2007/0201289 | A1* | 8/2007 | Joo | G11C 29/848 365/200 |
| 2008/0049038 | A1* | 2/2008 | Bae | G09G 5/39 345/573 |

(Continued)

FOREIGN PATENT DOCUMENTS

| | | | |
|---|---|---|---|
| CN | 104201941 | B | 1/2017 |
| JP | 2010-54691 | A | 3/2010 |

(Continued)

*Primary Examiner* — Gerald Johnson
(74) *Attorney, Agent, or Firm* — Lee IP Law, P.C.

(57) ABSTRACT

A display apparatus includes a display panel; and a display driver integrated circuit (DDI) chip coupled to the display panel, the DDI chip being configured to generate a display driving signal for driving the display panel based on image data. The DDI chip may include: a first embedded memory device embedded in the DDI chip and configured to store compensation data for compensating for electrical and optical characteristics of a plurality of pixels included in the display panel; a timing controller configured to control signals for driving the display panel, and to generate a data control signal based on the image data and the compensation data; and a data driver configured to provide a data voltage to the display panel according to the data control signal. The first embedded memory device may not include static random access memory (SRAM).

19 Claims, 7 Drawing Sheets

(56) References Cited

U.S. PATENT DOCUMENTS

| | | | | |
|---|---|---|---|---|
| 2008/0186303 | A1 | 8/2008 | Takahashi | |
| 2010/0207952 | A1 | 8/2010 | Mani et al. | |
| 2013/0141474 | A1* | 6/2013 | Kim | G09G 3/3674 345/690 |
| 2016/0163254 | A1 | 6/2016 | Lee et al. | |
| 2017/0046004 | A1* | 2/2017 | Choi | G06F 3/0446 |
| 2018/0268780 | A1* | 9/2018 | Bae | G09G 3/20 |
| 2018/0374526 | A1 | 12/2018 | Lee et al. | |
| 2019/0287479 | A1 | 9/2019 | Amirkhany | |

FOREIGN PATENT DOCUMENTS

| | | | |
|---|---|---|---|
| KR | 10-2014-0079122 | A | 6/2014 |
| KR | 10-2019-0109271 | A | 9/2019 |

* cited by examiner

DISPLAY DRIVER INTEGRATED CIRCUIT (DDI) CHIP AND DISPLAY APPARATUS

CROSS-REFERENCE TO RELATED APPLICATION

Korean Patent Application No. 10-2020-0068605, filed on Jun. 5, 2020, in the Korean Intellectual Property Office, and entitled: "Display Driver Integrated Circuit (DDI) Chip and Display Apparatus," is incorporated by reference herein in its entirety.

BACKGROUND

1. Field

Embodiments relate to a semiconductor apparatus, and more particularly, to a display driver integrated circuit (DDI) chip that drives a display panel and a display apparatus including the DDI chip.

2. Description of the Related Art

A display apparatus may include a display panel that displays an image and a DDI chip that drives the display panel. The DDI chip may drive the display panel by receiving image data from the outside and applying an image signal corresponding to the received image data to a data line of the display panel.

SUMMARY

Embodiments are directed to a display apparatus, including a display panel; and a display driver integrated circuit (DDI) chip coupled to the display panel, the DDI chip being configured to generate a display driving signal for driving the display panel based on image data. The DDI chip may include: a first embedded memory device embedded in the DDI chip and configured to store compensation data for compensating for electrical and optical characteristics of a plurality of pixels included in the display panel; a timing controller configured to control signals for driving the display panel, and to generate a data control signal based on the image data and the compensation data; and a data driver configured to provide a data voltage to the display panel according to the data control signal. The first embedded memory device may not include static random access memory (SRAM).

Embodiments are also directed to a display apparatus, including a display panel including a plurality of pixels; and a display driver integrated circuit (DDI) chip coupled to the display panel, the DDI chip being configured to generate a display driving signal for driving the display panel. The DDI chip may include: a first embedded memory device embedded in the DDI chip, the first embedded memory device having a first read frequency for outputting stored data and having a first write frequency for storing data, the first read frequency being greater than the first write frequency; a second embedded memory device embedded in the DDI chip and having a second write frequency used for storing the data equal to a second read frequency used for outputting the stored data; a timing controller configured to generate a data control signal based on compensation data for compensating for electrical and optical characteristics of the plurality of pixels and image data; and a data driver configured to provide a data voltage to the display panel based on the data control signal. The compensation data may be stored in the first embedded memory device, and the image data is stored in the second embedded memory device.

Embodiments are also directed to a display driver integrated circuit (DDI) chip configured to generate a signal for driving a display panel based on image data, the DDI chip including: an embedded memory device embedded in the DDI chip and configured to store compensation data for compensating for electrical characteristics of a plurality of pixels included in the display panel, and configured to store the image data; and a timing controller configured to generate a data control signal based on the image data and the compensation data. The embedded memory device may not include static random access memory (SRAM).

BRIEF DESCRIPTION OF THE DRAWINGS

Features will become apparent to those of skill in the art by describing in detail example embodiments with reference to the attached drawings in which.

DETAILED DESCRIPTION

Figure 1:
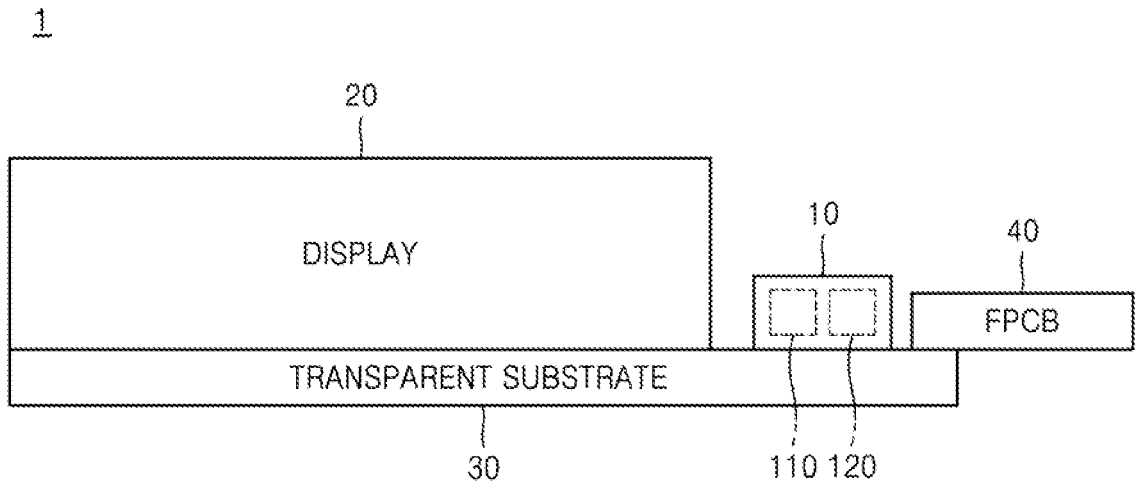
FIG. 1 is a cross-sectional view illustrating a display apparatus according to an example embodiment.

FIG. 1 is a cross-sectional view illustrating a display apparatus 1 according to an example embodiment.

Referring to FIG. 1, the display apparatus 1 may include a display driver integrated circuit (DDI) chip 10, a display panel 20, a transparent substrate 30, and a flexible printed circuit board (FPCB) 40.

According to an example embodiment, the display apparatus 1 may be mounted on an electronic device having an image display function. For example, the electronic device may include a smartphone, a tablet personal computer (PC), a portable multimedia player (PMP), a camera, a wearable device, a television, a digital video disc (DVD) player, a refrigerator, an air conditioner, an air purifier, a set-top box, a robot, a drone, a medical device, a navigation device, a global positioning system (GPS) receiver, an advanced driver-assistance system (ADAS), a vehicle device, furniture, a measuring device, etc.

According to an example embodiment, the DDI chip 10 and the display panel 20 may be implemented as one module. According to an example embodiment, the transparent substrate 30 may be a glass substrate, and the display apparatus 1 may include a chip on glass (COG) structure in which the DDI chip 10 is mounted on the glass substrate. According to another example embodiment, the transparent substrate 30 may be a polyimide substrate, and the display apparatus 1 may include a chip on polyimide (COP) structure in which the DDI chip 10 is mounted on the polyimide substrate. According to another example embodiment, a film substrate such as a flexible printed circuit (FPC) may be between the transparent substrate 30 and the DDI chip 10, and the display apparatus 1 may include a chip on film (COF) structure in which the DDI chip 10 is mounted on the film substrate.

According to an example embodiment, the DDI chip 10 may include first and second embedded memory devices 110 and 120 embedded in the DDI chip 10. The first and second embedded memory devices 110 and 120 may be memory devices of different types. According to an example embodiment, the first and second embedded memory devices 110 and 120 may be functional blocks such as intellectual property (IP).

According to an example embodiment, the first embedded memory device 110 may be a nonvolatile memory device. According to an example embodiment, the first embedded memory device 110 may include any one of magnetic random access memory (MRAM), ferroelectric RAM (FRAM), phase-change RAM (PRAM), resistance RAM (RRAM), and flash memory. When the first embedded memory device 110 includes any one of MRAM, PRAM, RRAM, and FRAM, the DDI chip 10 including the first embedded memory device 110 may not be processed differently from a general DDI chip (including only static RAM (SRAM)) in a front end of line (FEOL) process, and thus, the efficiency of DDI chip design may be improved.

According to an example embodiment, the second embedded memory device 120 may be a volatile memory device. The second embedded memory device 120 may be one of SRAM and dynamic RAM (DRAM).

According to an example embodiment, the capacity of the MRAM memory device per area is greater than the capacity of the SRAM memory device per area, and thus the area of the DDI chip 10 may be reduced. Due to the reduction in the size of the DDI chip 10, the gross die, which is the number of chips (dies) produced per wafer, may be increased. For example, the gross die of a DDI chip of a set capacity including SRAM embedded memory may be about 1034 with respect to a 300 mm wafer, whereas the gross die of the DDI chip 10 of the same capacity including the SRAM embedded memory and MRAM embedded memory may be 1074. Accordingly, the production cost of the DDI chip 10 may be reduced.

In addition, due to the reduction in the size of the DDI chip 10, the area of the transparent substrate 30 on which the DDI chip 10 is mounted may be reduced, and thus, the integration of the display apparatus 1 may be improved. For example, when the display apparatus 1 is a display apparatus for a handset, the size of the bezel may be reduced, and thus, a high level of user experience may be provided.

According to an example embodiment, the FPCB 40 may be electrically connected to the transparent substrate 30. According to an example embodiment, the DDI chip 10 may include the first and second embedded memory devices 110 and 120, and a separate memory module may not be mounted on the FPCB 40. Accordingly, the manufacturing cost of the display apparatus 1 may be reduced.

In general, if an operation such as pixel compensation were to be performed using a memory module mounted on the FPCB 40, an external memory of the DDI chip 10 may thus be used. This may increase the power used for driving due to the external memory and a high-speed interface.

Table 1 shows comparison of the power consumption of a DDI chip of Comparative Example 1 including only SRAM, the power consumption of a DDI chip of Comparative Example 2 using an external memory on a FPCB, and the power consumption of a DDI chip of an Experimental Example including MRAM and SRAM. In Table. 1, each numerical value is described in arbitrary units.

TABLE 1

| | Comparative Example 1 | Comparative Example 2 | Experimental Example |
|---|---|---|---|
| Video | 227 | 263 | 241 |
| Still image | 207 | 242 | 223 |

Referring to Table 1, it can be seen that the DDI chip of the Experimental Example (including the MRAM device and the SRAM device) used an amount of power that was equivalent to that of Comparative Example 1 (using only SRAM). Further, the DDI chip of the Experimental Example operated at a low power that was about 91% to about 92% compared to Comparative Example 2 in which pixel correction is performed using the external memory on the FPCB.

Figure 2:
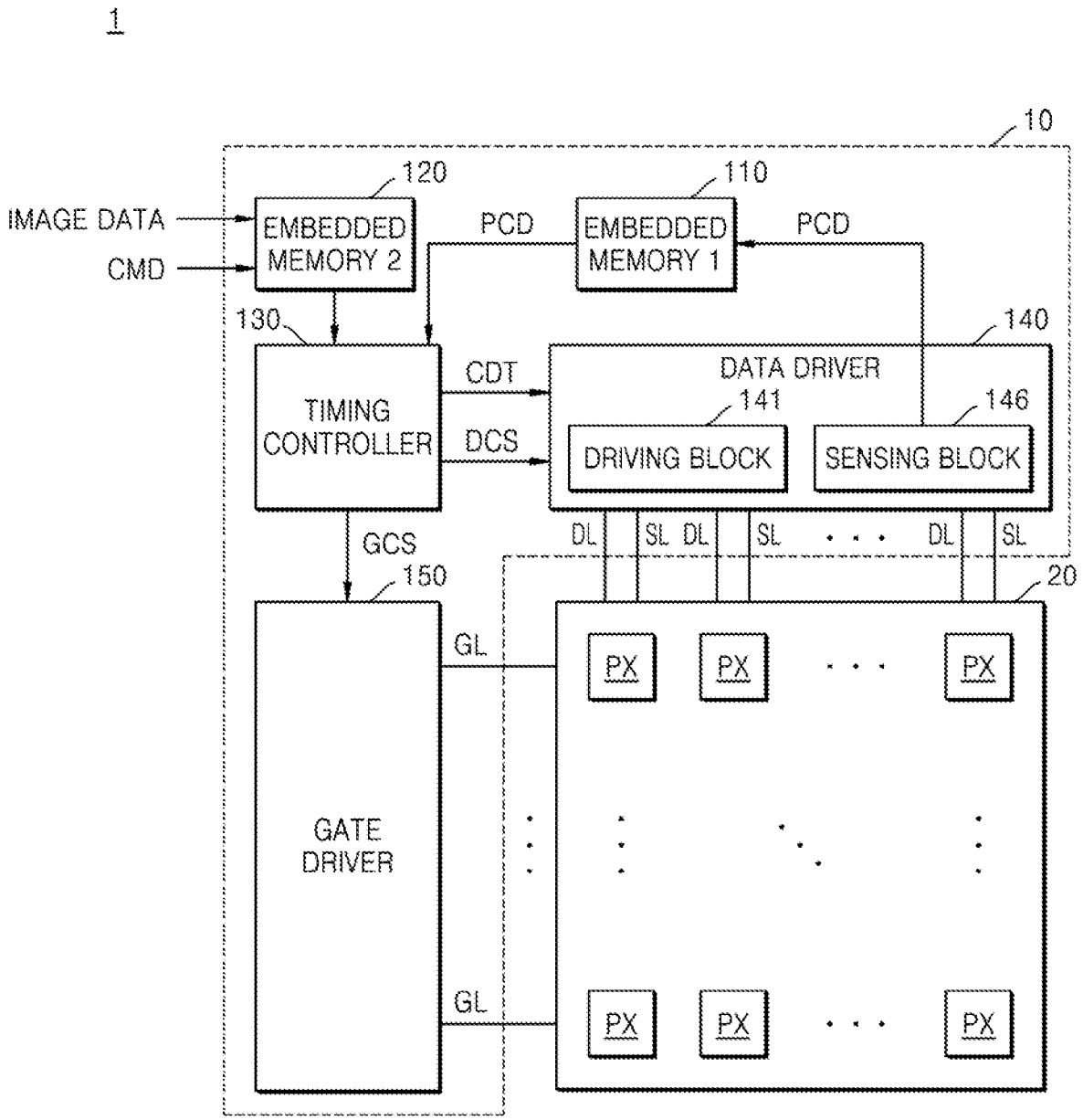
FIG. 2 is a block diagram illustrating a display apparatus according to an example embodiment.

FIG. 2 is a block diagram illustrating the display apparatus 1 according to an example embodiment.

Referring to FIG. 2, the display panel 20 may include a plurality of signal lines (for example, a plurality of gate lines GL, a plurality of data lines DL, and a plurality of sensing lines SL), and a plurality of pixels PX (for example, a pixel array) connected to the plurality of signal lines and arranged in the form of a matrix.

Each of the plurality of pixels PX may include a sub-pixel representing red, a sub-pixel representing green, and a sub-pixel representing blue. A user may recognize various colors by mixing red, green, and blue light displayed by the sub-pixels included in adjacent pixels PX.

According to an example embodiment, the display panel 20 may be an organic light emitting diode (OLED) display panel in which each pixel PX includes a light emitting device, for example, an OLED. However, the display panel 20 may be another type of flat panel display or a flexible display panel.

The DDI chip 10 may include a timing controller 130, a data driver 140, and a gate driver 150, in addition to the first embedded memory device 110 and the second embedded memory device 120.

The second embedded memory device 120 may operate as a frame buffer memory. Data stored in the second embedded memory device 120 may be used for overdriving.

The gate driver 150 may drive the plurality of gate lines GL of the display panel 20 using a gate driver control signal GCS (e.g., a gate timing control signal) received from the timing controller 130. The gate driver 150 may provide pulses of a gate-on voltage, such as a scan voltage or a sensing-on voltage, to the gate line GL in a driving period of each of the plurality of gate lines GL based on the gate driver control signal GCS.

The data driver 140 may include a driving block 141 and a sensing block 146, may drive the plurality of pixels PX through the plurality of data lines DL, and may sense (measure) the electrical characteristics of the plurality of pixels PX through the sensing lines SL.

The driving block 141 may perform digital-analog conversion to image data received from the timing controller 130 (for example, compensated input data CDT with respect to each of the plurality of pixels PX) and provide driving signals, which are the converted analog signals, to the display panel 20 through the data lines DL. The driving signals may be provided to the plurality of pixels PX respectively through the plurality of data lines DL.

In a display mode in which an image is displayed and a sensing mode in which deterioration of the pixel PX is calculated, the driving block 141 may convert image data provided from the timing controller 130 or internally set sensing data to driving signals (e.g., driving voltages) and output the driving signals to the data lines DL of the display panel 20. The driving block 141 may include a plurality of channel drivers, and each of the plurality of channel drivers may convert received data, such as the compensated input data CDT, into the driving signal. As described above, the plurality of channel drivers perform digital-to-analog conversion, and may be referred to as a digital-to-analog converter.

The sensing block 146 may periodically or aperiodically measure the electrical characteristics of the plurality of pixels PX. The sensing block 146 may sense (measure) the electrical characteristics of the plurality of pixels PX in the sensing mode. The sensing mode may be set in, for example, a manufacturing operation of the display apparatus 1, a booting period after power-on of the display apparatus 1, an end period during power-off, or a dummy period (or a vertical blanking period) between frame display periods of the display panel 20.

The sensing block 146 may receive a sensing signal, for example, a pixel voltage or a pixel current, representing the electrical characteristics of each of the plurality of pixels PX through the plurality of sensing lines SL, and perform analog-digital conversion to the sensing signal to generate pixel compensation data PCD. The generated pixel compensation data PCD may be stored in the first embedded memory device 110, and the pixel compensation data PCD stored in the first embedded memory device 110 may be read by the timing controller 130.

The timing controller 130 may control overall operations of the display apparatus 1, and control driving timing of the data driver 140 and the gate driver 150 based on commands CMD received from an external processor, for example, a main processor of an electronic device in which the display apparatus 1 is mounted, or an image processor. The timing controller 130 may be implemented with any one of hardware, software, and a combination of hardware and software. The timing controller 130 may be implemented with digital logic circuits and registers that perform functions described below.

The timing controller 130 may provide a data driver control signal DCS to the data driver 140. The operation and operation timing of the driving block 141 and the sensing block 146 of the data driver 140 may be controlled by the data driver control signal DCS.

Also, the timing controller 130 may provide the gate driver control signal GCS to the gate driver 150. As described above, the gate driver 150 may drive the plurality of gate lines GL of the display panel 20 in response to the gate driver control signal GCS.

In addition, the timing controller 130 may perform various image processing operations on the image data received from the external processor for a change in the format of the image data and a reduction in the power consumption. The image data may include input data corresponding to each pixel PX, the timing controller 130 may perform data compensation on the image data of each pixel PX, and provide the compensated data CDT to the data driver 140, to compensate for deterioration of the plurality of pixels PX of the display panel 20. To this end, the timing controller 130 may include a deterioration compensator.

According to an example embodiment, the timing controller 130 may perform stress profiling of calculating an accumulation deterioration value with respect to each of the plurality of pixels PX based on the pixel compensation data PCD. Data about the accumulation deterioration value generated by stress profiling and data used for stress profiling may be stored in the first embedded memory device 110. According to an example embodiment, the timing controller 130 may perform external pixel compensation on the data of the pixel PX based on the calculated accumulation deterioration value and a deterioration model.

The accumulation deterioration value may be generated by accumulating deterioration values calculated in units of a predetermined time (e.g., a predetermined frame) based on the compensated input data CDT provided to the pixels PX or driving data corresponding to the driving signal provided to the pixels PX. The driving data is data in which a luminance characteristic and a gamma characteristic are reflected on the compensated input data CDT, and may be a digital value indicating a level of a driving signal, for example, a voltage level.

In addition, the timing controller 130 may correct the accumulation deterioration value based on the sensing data received from the data driver 140. The timing controller 130 may select at least one of the plurality of pixels PX as a sensing target and control the sensing block 146 of the data driver 140 to sense the electrical characteristics of the selected pixel PX. The timing controller 130 may correct the accumulation deterioration value of the sensed pixel PX based on the sensing data received from the data driver 140.

Figure 3:
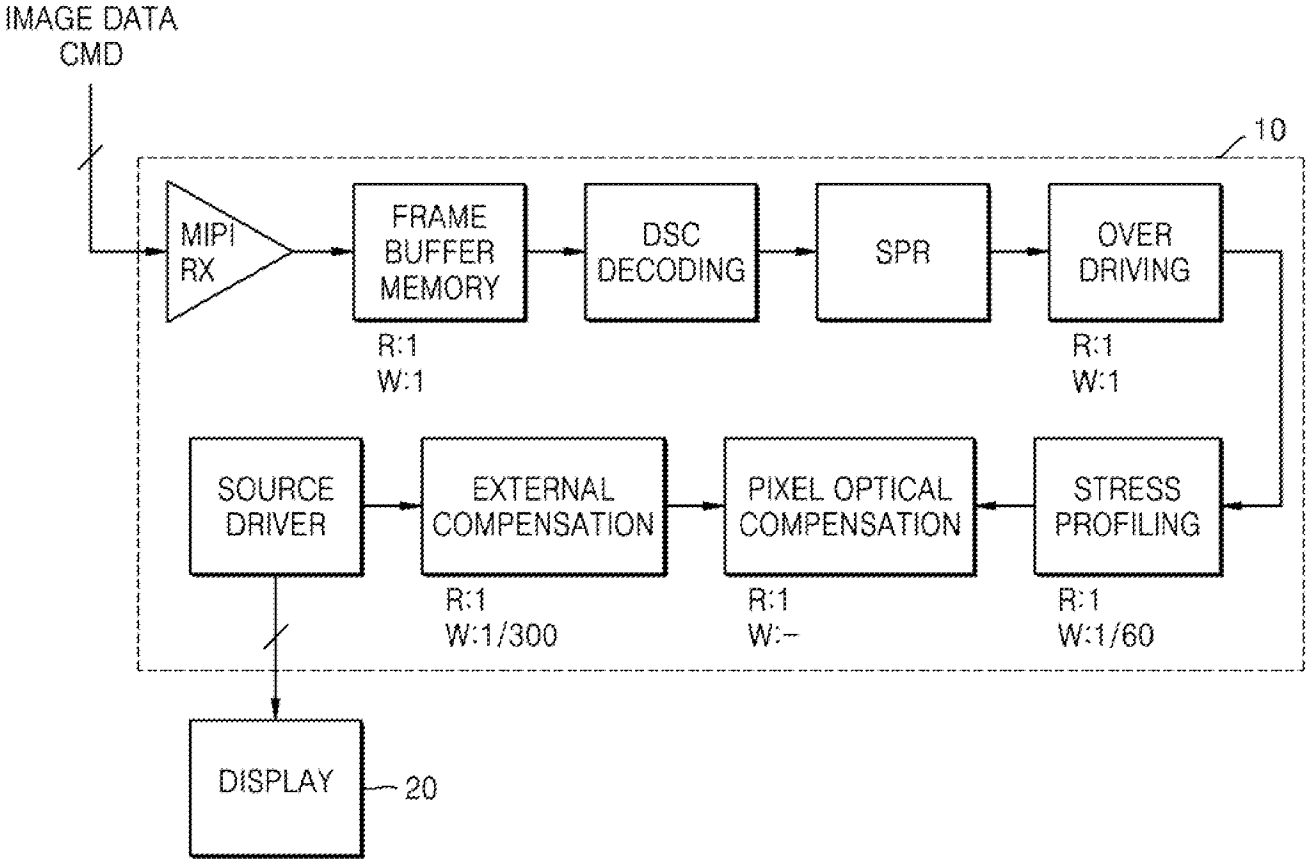
FIG. 3 is a block diagram illustrating signal processing of a display apparatus according to an example embodiment.

FIG. 3 is a block diagram illustrating signal processing of the display apparatus 1 according to an example embodiment.

Referring to FIGS. 2 and 3, the DDI chip 10 may communicate with a host processor through a receiving module such as a Mobile Industry Processor Interface (MIPI RX). The DDI chip 10 may receive image data and a control command CMD from the host processor. The control command CMD may include, for example, a vertical synchronization signal and a horizontal synchronization signal. The DDI chip 10 may operate in any one of a command mode (in which only the image data is received from the host processor) and a video mode (in which the image data and the control command CMD are received from the host processor).

The host processor may generate the image data and a timing signal to be displayed on the display panel 20, and transmit the image data and the control command CMD to the DDI chip 10. According to an example embodiment, the host processor may be a graphics processor, for example. The host processor may be various types of processors such as a central processing unit (CPU), a microprocessor, a multimedia processor, an application processor, etc. The host processor may be implemented as an integrated circuit (IC) or a system on chip (SoC).

Image data received through the receiving module MIPI RX may be input to the timing controller 130 via a frame buffer memory. The frame buffer memory may store the image data. The second embedded memory device 120 may operate as the frame buffer memory. The read and write frequencies of a first frame buffer memory may be expressed as a value of 1, wherein the read and write frequencies are values expressed by standardizing the refresh rate of the display panel 20 as a value of 1. Thus, in an example, when the refresh rate of the display panel 20 is 50 Hz, the read and write frequencies of the first frame buffer memory are 50 Hz, and, in another example, when the refresh rate of the display panel 20 is 60 Hz, the read and write frequencies of the first frame buffer memory are 60 Hz.

The image data stored in the frame buffer memory may be performed by a display stream compression (DSC) decoder. DSC is a technology that realizes a 3:1 compression ratio without a loss in quality of the image data. The DSC decoder may be included in the timing controller 130, for example Subsequently, the timing controller 130 may perform sub pixel rendering (SPR). SPR is a technology that increases the effective resolution of a liquid crystal display (LCD) or an OLED display by rendering pixels considering the physical characteristics of a screen type. Text may be anti-aliased or the resolution of image type may increase by using that each pixel in the LCD and the OLED display actually includes individual red, green, and blue or other colored sub-pixels.

Subsequently, the timing controller 130 may perform overdriving. Overdriving is a technology that modulates and displays image data to speed up the response speed of each pixel. Overdriving may be based on a comparison between image data of a previous frame and image data of a current frame that are stored in the second embedded memory device 120. The read and write frequencies of the second embedded memory device 120 for performing overdriving may be expressed as a value of 1, as described above.

Subsequently, the timing controller 130 may perform stress profiling. Data according to the stress profiling may be stored in the first embedded memory device 110. Stress profiling may be the recording and calculation of the above-described accumulation stress. In an example embodiment, when stress profiling is performed, the read frequency of the first embedded memory device 110 may be expressed as a value of 1 and the write frequency may be expressed as a value 1/60, for example. In an example embodiment, when stress profiling is performed, the read frequency of the first embedded memory device 110 may be expressed as a value of 1 and the write frequency may be expressed as a value of 1/50.

Subsequently, the timing controller 130 may perform pixel optical compensation on the image data. Pixel optical compensation is for compensating the optical characteristics of each of pixels, and may be based on optical measurement data of each of the pixels immediately after manufacture of the display panel 20. The optical measurement data of each of the pixels may be stored in the first embedded memory device 110. A write operation for pixel optical compensation may not be performed, and the read frequency for pixel optical compensation may be expressed as a value of 1.

Subsequently, the timing controller 130 may perform pixel external compensation on the image data. Pixel external compensation is a technology that compensates for a data signal provided to a data driver based on the accumulation deterioration value of a pixel. Data about pixel external compensation may be stored in the first embedded memory device 110. The read frequency of the first embedded memory device 110 for performing pixel external compensation may be expressed as a value of 1, and the write frequency may be expressed as a value of 1/300, for example. The read frequency of the first embedded memory device 110 for performing pixel external compensation may be expressed as a value of 1 and the write frequency may be expressed as a value of 1/250.

According to an example embodiment, a first write frequency indicating the frequency of storing data in the first embedded memory device 110 may be less than a first read frequency for outputting data stored in the first embedded memory device 110. According to an example embodiment, the first write frequency may be in a range of about 1/1000 to about 1/10 of the first read frequency and thus the first write frequency may be in a range of about 1/1000 to about 1/10 of the screen refresh rate of the display panel 20.

As described above, the first read frequency may be substantially the same as the screen refresh rate. A second read frequency and a second write frequency of the second embedded memory device 120 may be substantially the same as the screen refresh rate, for example.

According to an example embodiment, when the first embedded memory device 110 is any one of an MRAM, a PRAM, and an RRAM, the first embedded memory device 110 may have a slightly lower write speed than when using an SRAM. However, the first embedded memory device 110 may be used for operations that do not require high write speed, such as stress profiling, pixel optical compensation, and pixel external compensation. Thus, the performance of the DDI chip 10 may not be lowered. Accordingly, the DDI chip 10 may be manufactured at low cost and with improved integration without deteriorating the performance of the DDI chip 10.

Figure 4:
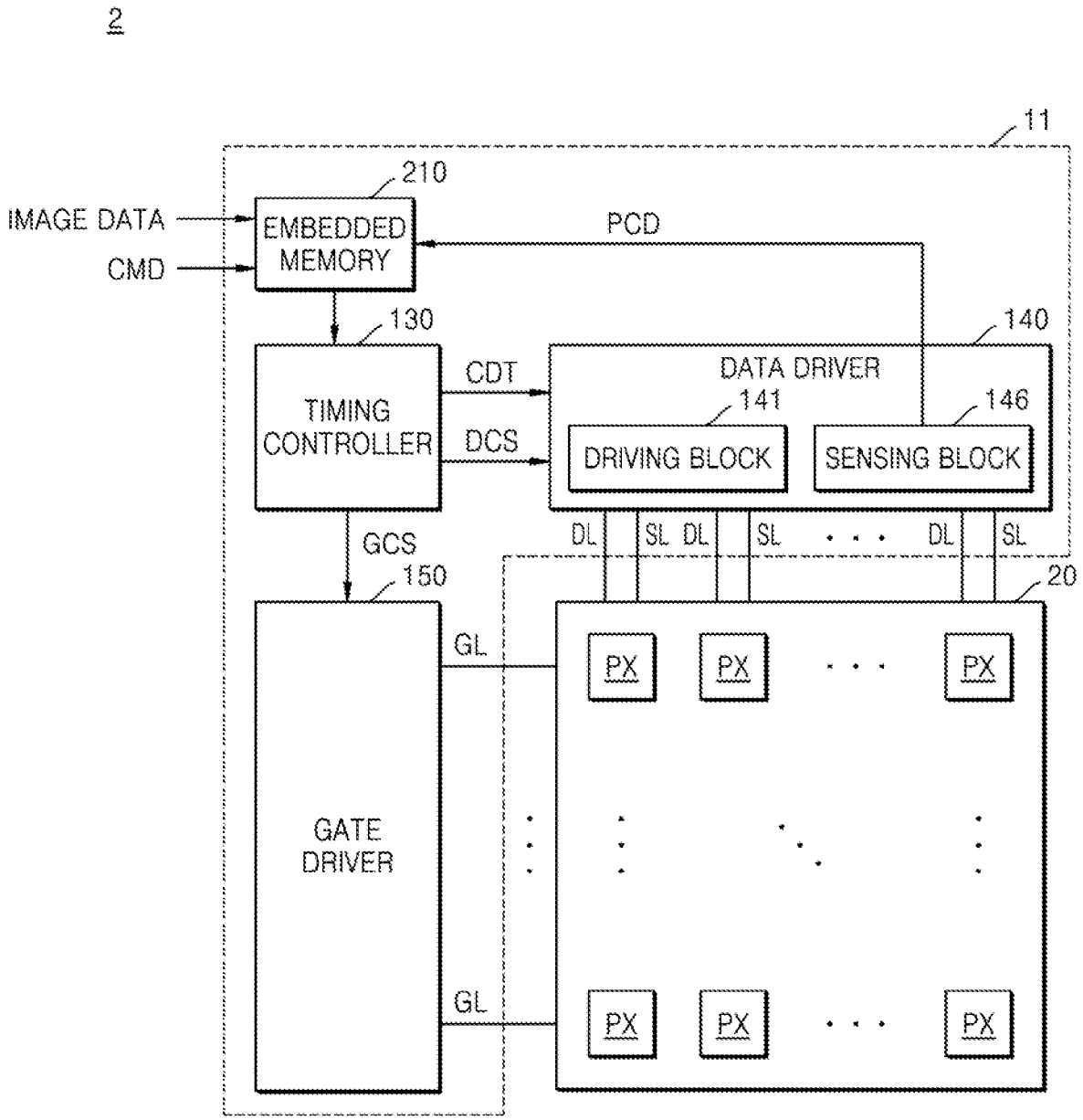
FIG. 4 is a block diagram illustrating a display apparatus according to an example embodiment.

FIG. 4 is a block diagram illustrating a display apparatus 2 according to an example embodiment. For convenience of description, descriptions redundant to those given with reference to FIGS. 1 to 3 may be omitted, and differences will be mainly described for FIG. 4.

Referring to FIG. 4, the display apparatus 2 may include a DDI chip 11 and the display panel 20. The display panel 20 may be substantially the same as described with reference to FIGS. 1 to 3.

The DDI chip 11 may include an embedded memory device 210 of a single type. The embedded memory device 210 may be a nonvolatile memory device. The embedded memory device 210 may not be SRAM. The embedded memory device 210 may be any one of MRAM, FRAM, RRAM, PRAM, and flash memory. Accordingly, the DDI chip 11 may have an improved integration compared to a general DDI chip.

According to an example embodiment, the embedded memory device 210 may be used for operations such as a buffer frame memory and overdriving, in addition to stress profiling, pixel optical compensation, and pixel external compensation.

The DDI chip 11 may further include the timing controller 130, the data driver 140, and the gate driver 150, which may be substantially the same as those described with reference to FIGS. 1 to 3.

Figure 5:
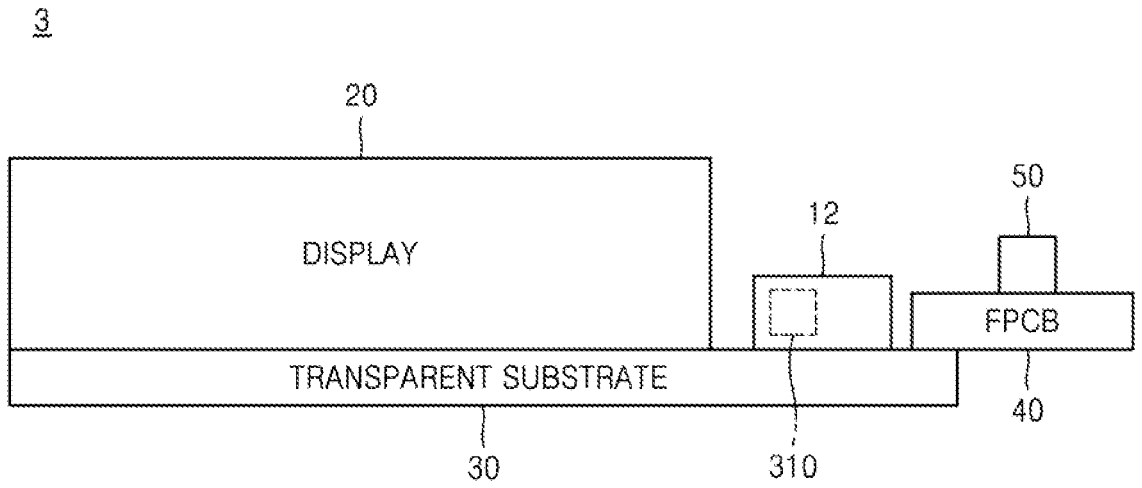
FIG. 5 is a cross-sectional view illustrating a display apparatus according to an example embodiment.
Figure 6:
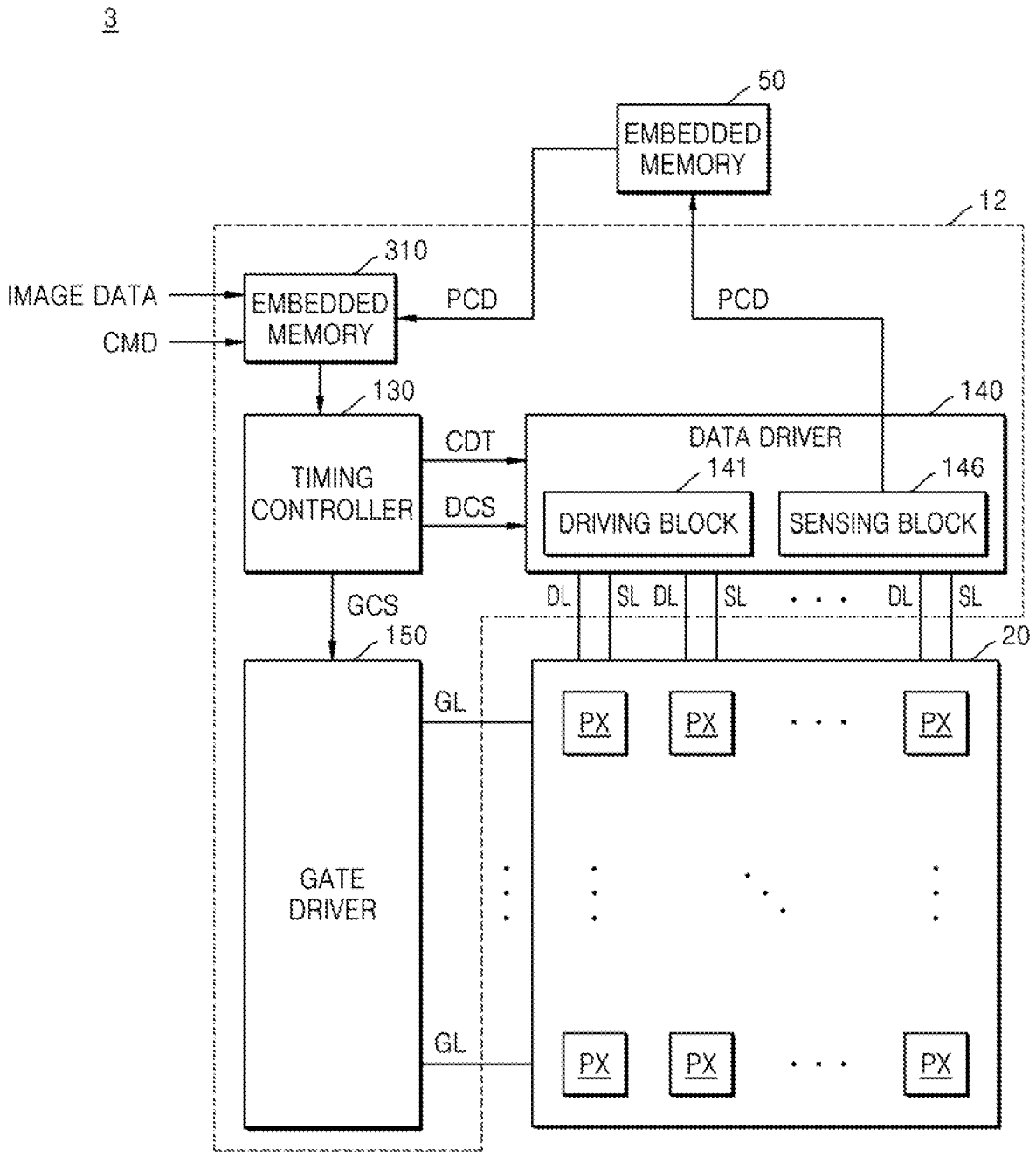
FIG. 6 is a block diagram illustrating the display apparatus according to an example embodiment.

FIG. 5 is a cross-sectional view illustrating a display apparatus 3 according to an example embodiment, and FIG. 6 is a block diagram illustrating the display apparatus 3 according to an example embodiment. For convenience of description, descriptions redundant with those given with reference to FIGS. 1 to 3 will be omitted, and differences will be mainly described for FIGS. 5 and 6.

Referring to FIGS. 5 and 6, the display apparatus 3 may include a DDI chip 12, the display panel 20, the transparent substrate 30, the FPCB 40, and an external memory 50 on the FPCB 40.

The DDI chip 12 may include an embedded memory device 310 of a single type. The embedded memory device 310 may be a volatile memory device. The embedded memory device 310 may not be SRAM. The embedded memory device 310 may be DRAM. Accordingly, the DDI chip 12 may have an improved integration compared to a general DDI chip.

According to an example embodiment, the embedded memory device 310 may be used for operations such as a buffer frame memory, overdriving, etc.

The DDI chip 12 may further include the timing controller 130, the data driver 140, and the gate driver 150, which may be substantially the same as those described with reference to FIGS. 1 to 3.

According to an example embodiment, the external memory 50 may be electrically connected to the DDI chip 12 through the FPCB 40. The external memory 50 may be a nonvolatile memory. The external memory 50 may be used to perform stress profiling, pixel optical compensation, and pixel external compensation. The external memory 50 may be used for operations such as the buffer frame memory, overdriving, etc. Although one external memory 50 is shown in FIG. 5, two or more external memories 50 may be provided on the FPCB 40.

Figure 7:
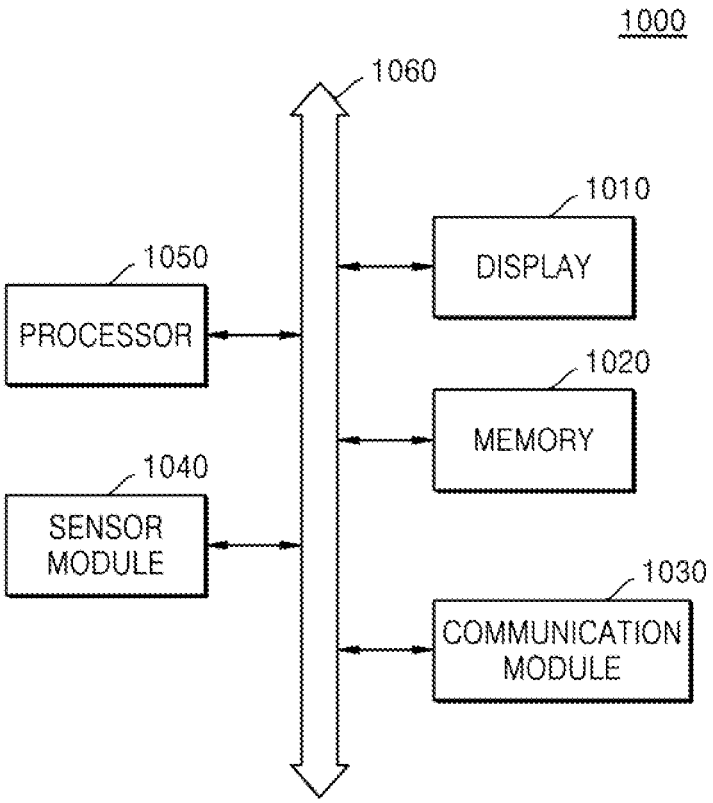
FIG. 7 illustrates an embodiment of a display apparatus according to an example embodiment.

FIG. 7 illustrates an electronic device according to an example embodiment.

Referring to FIG. 7, an electronic device 1000 according to an example embodiment may include a display apparatus 1010, a memory 1020, a communication module 1030, a sensor module 1040, and a processor 1050. The electronic device 1000 may be or include a television, a desktop computer, etc., in addition to mobile devices such as a smart phone, a tablet PC, a laptop computer, etc. Components such as the display apparatus 1010, the memory 1020, the communication module 1030, the sensor module 1040, and the processor 1050 may communicate with each other through a bus 1060.

The display apparatus 1010 may be any one of the display apparatuses 1, 2, and 3 described above with reference to FIGS. 1 to 6. According to an example embodiment, the display apparatus 1010 may include a DDI chip having an improved integration according to an embodiment. Thus, the display apparatus 1010 may allow for low manufacturing cost and power consumption, while providing a high level of user experience.

By way of summation and review, an organic light emitting diode (OLED) display panel may be formed such that each of a plurality of pixels of a pixel array includes an OLED. The optical and electrical characteristics of the pixels may be compensated in order to implement higher image quality using the OLED display panel. As the number of pixels of the OLED display panel increases, the amount of data used for compensating for the optical and electrical characteristics of the pixels may also increase. Accordingly, a DDI chip having a higher memory capacity may be used.

As described above, embodiments may provide a display driver integrated circuit (DDI) chip having improved integration and improved power efficiency, and a display apparatus including the DDI chip.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display apparatus, comprising:

a display panel; and a display driver integrated circuit (DDI) chip coupled to the display panel, the DDI chip being configured to generate a display driving signal for driving the display panel based on image data, wherein the DDI chip includes:

a first embedded memory device embedded in the DDI chip and configured to store compensation data for compensating for electrical and optical characteristics of a plurality of pixels included in the display panel;

a timing controller configured to control signals for driving the display panel, and to generate a data control signal based on the image data and the compensation data; and a data driver configured to provide a data voltage to the display panel according to the data control signal, wherein the first embedded memory device does not include static random access memory (SRAM), and wherein a second embedded memory device is embedded in the DDI chip and configured to store the image data.

2. The display apparatus as claimed in claim 1, wherein the first embedded memory device includes a nonvolatile memory device.

3. The display apparatus as claimed in claim 1, wherein the first embedded memory device includes any one of a magnetic random access memory (MRAM), a ferroelectric random access memory (FRAM), a phase-change random access memory (PRAM), a resistance random access memory (RRAM), and a flash memory.

4. The display apparatus as claimed in claim 1, wherein the second embedded memory device includes a volatile memory device.

5. The display apparatus as claimed in claim 1, wherein the second embedded memory device includes one of a static random access memory (SRAM) and a dynamic random access memory (DRAM).

6. The display apparatus as claimed in claim 1, wherein the image data is stored only in the second embedded memory device.

7. The display apparatus as claimed in claim 1, wherein the second embedded memory device is also configured to store data about overdriving of the display panel.

8. The display apparatus as claimed in claim 1, further comprising a printed circuit board electrically connected to the display panel, wherein a memory module is not mounted on the printed circuit board.

9. The display apparatus as claimed in claim 1, wherein:

the data driver includes a sensing block configured to measure electrical characteristics of the plurality of pixels, and the first embedded memory device is configured to store the compensation data that includes data about the electrical characteristics of the plurality of pixels measured by the sensing block as the compensation data.

10. The display apparatus as claimed in claim 9, wherein the timing controller is configured to generate the data control signal, which compensates for the electrical characteristics of the plurality of pixels, based on the compensation data stored in the first embedded memory device.

11. The display apparatus as claimed in claim 1, wherein the first embedded memory device is configured to store the compensation data that includes data about stress accumulated in the plurality of pixels, data about compensation of image data to be provided to the plurality of pixels, and data about compensation of optical characteristics of the plurality of pixels.

12. A display apparatus, comprising:

a display panel including a plurality of pixels; and a display driver integrated circuit (DDI) chip coupled to the display panel, the DDI chip being configured to generate a display driving signal for driving the display panel, wherein the DDI chip includes:

a first embedded memory device embedded in the DDI chip, the first embedded memory device having a first read frequency for outputting stored data and having a first write frequency for storing data, the first read frequency being greater than the first write frequency;

a second embedded memory device embedded in the DDI chip and having a second write frequency used for storing the data equal to a second read frequency used for outputting the stored data;

a timing controller configured to generate a data control signal based on compensation data for compensating for electrical and optical characteristics of the plurality of pixels and image data; and a data driver configured to provide a data voltage to the display panel based on the data control signal, wherein the compensation data is stored in the first embedded memory device, and the image data is stored in the second embedded memory device.

13. The display apparatus as claimed in claim 12, wherein the first write frequency is less than a screen refresh rate of the display panel.

14. The display apparatus as claimed in claim 12, wherein the first write frequency is in a range of about 1/1000 to about 1/10 of a screen refresh rate of the display panel.

15. The display apparatus as claimed in claim 12, wherein the first read frequency is substantially the same as a screen refresh rate of the display panel.

16. The display apparatus as claimed in claim 12, wherein the second read frequency and the second write frequency are substantially the same as a screen refresh rate of the display panel.

17. The display apparatus as claimed in claim 12, wherein:

the first embedded memory device includes any one of a magnetic random access memory (MRAM), a phase-change random access memory (PRAM), a ferroelectric random access memory (FRAM), and a resistance random access memory (RRAM), and the second embedded memory device includes one of a static random access memory (SRAM) and a dynamic random access memory (DRAM).

18. A display driver integrated circuit (DDI) chip configured to generate a signal for driving a display panel based on image data, the DDI chip comprising:

an embedded memory device embedded in the DDI chip and configured to store compensation data for compensating for electrical characteristics of a plurality of pixels included in the display panel, and configured to store the image data; and a timing controller configured to generate a data control signal based on the image data and the compensation data, wherein the embedded memory device does not include static random access memory (SRAM).

19. The DDI chip as claimed in claim 18, wherein the embedded memory device includes any one of magnetic random access memory (MRAM), phase-change random access memory (PRAM), ferroelectric random access memory (FRAM), and resistance random access memory (RRAM).

* * * * *